US010144985B2

(12) United States Patent
Saito et al.

(10) Patent No.: US 10,144,985 B2
(45) Date of Patent: Dec. 4, 2018

(54) STEEL SHEET FOR CAN AND METHOD FOR MANUFACTURING THE SAME

(71) Applicant: JFE STEEL CORPORATION, Tokyo (JP)

(72) Inventors: Hayato Saito, Fukuyama (JP); Yusuke Nakagawa, Chiba (JP); Katsumi Kojima, Fukuyama (JP); Hiroki Nakamaru, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 211 days.

(21) Appl. No.: 14/906,131

(22) PCT Filed: Jul. 8, 2014

(86) PCT No.: PCT/JP2014/003613

§ 371 (c)(1),
(2) Date: Jan. 19, 2016

(87) PCT Pub. No.: WO2015/008454

PCT Pub. Date: Jan. 22, 2015

(65) Prior Publication Data

US 2016/0160308 A1 Jun. 9, 2016

(30) Foreign Application Priority Data

Jul. 17, 2013 (JP) ..... 2013-148126

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C21D 9/46*** | (2006.01) |
| ***C21D 9/48*** | (2006.01) |
| ***C21D 8/02*** | (2006.01) |
| ***C21D 8/04*** | (2006.01) |
| ***C22C 38/00*** | (2006.01) |
| ***C22C 38/14*** | (2006.01) |
| ***C21D 1/26*** | (2006.01) |
| ***C21D 6/00*** | (2006.01) |

(52) U.S. Cl.

CPC ..... *C21D 9/46* (2013.01); *C21D 1/26* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0436* (2013.01); *C21D 8/0473* (2013.01); *C21D 9/48* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/005* (2013.01)

(58) Field of Classification Search
None
See application file for complete search history.

(56) References Cited

U.S. PATENT DOCUMENTS

| | | | |
|---|---|---|---|
| 2012/0018055 | A1 | 1/2012 | Nakagawa et al. |
| 2012/0255656 | A1 | 10/2012 | Nakagawa et al. |

FOREIGN PATENT DOCUMENTS

| | | | | |
|---|---|---|---|---|
| AU | 2010312372 | B2 | 4/2012 | |
| CN | 1114113 | A | 12/1995 | |
| CN | 1135940 | A | 11/1996 | |
| CN | 102597289 | A | 7/2012 | |
| EP | 0565066 | A1 | 10/1993 | |
| EP | 0662523 | A1 | 7/1995 | |
| EP | 0731182 | A2 | 9/1996 | |
| EP | 2 412 838 | A1 | 2/2012 | |
| EP | 2 479 308 | A1 | 7/2012 | |
| JP | 06-212353 | | 8/1994 | |
| JP | 06-248332 | | 9/1994 | |
| JP | 36-248339 | | 9/1994 | |
| JP | 10-060542 | * | 3/1998 | ..... C21D 9/46 |
| JP | 10-060542 | A | 3/1998 | |
| JP | H11-209845 | A | 8/1999 | |
| JP | 2010-229486 | A | 10/2010 | |
| JP | 2011-058036 | A | 3/2011 | |
| JP | 2011-094178 | A | 5/2011 | |
| JP | 2012-107315 | A | 6/2012 | |
| JP | 2013-019027 | A | 1/2013 | |

(Continued)

OTHER PUBLICATIONS

Machine-English translation of JP10-060542, Tosaka Akio et al., Mar. 3, 1998.*

Jul. 4, 2016 Extended European Search Report issued in European Application No. 14825747.0.

Jul. 27, 2016 Office Action issued in Chinese Patent Application No. 201480040093.9.

Sep. 6, 2017 Office Action issued in Korean Patent Application No. 10-2016-7002826.

Sep. 29, 2017 Office Action issued in Canadian Application No. 2,916,040.

May 31, 2016 Office Action issued in Japanese Patent Application No. 2015-527166.

(Continued)

*Primary Examiner* — Deborah Yee
(74) *Attorney, Agent, or Firm* — Oliff PLC

(57) ABSTRACT

A steel sheet exhibiting good drawability and excellent buckling strength of a can body portion against an external pressure, and a method for manufacturing the same. The steel sheet includes C: 0.0030% or more and 0.0100% or less, Si: 0.05% or less, Mn: 0.10% or more and 1.0% or less, P: 0.030% or less, S: 0.020% or less, Al: 0.010% or more and 0.100% or less, N: 0.0050% or less, Nb: 0.010% or more and 0.050% or less, and incidental impurities. Contents of C and Nb satisfy $0.10 \leq ([Nb]/92.9)/([C]/12) < 0.60$, the HR30T hardness of the steel sheet is 56 or more, and the average Young's modulus of the steel sheet is 210 GPa or more.

19 Claims, No Drawings

(56) References Cited

FOREIGN PATENT DOCUMENTS

| | | | |
|---|---|---|---|
| KR | 2012-0062930 | A | 6/2012 |
| WO | 2010/110485 | A1 | 9/2010 |
| WO | 2011/052763 | A1 | 5/2011 |

OTHER PUBLICATIONS

Sep. 7, 2016 Office Action issued in Australian Patent Application No. 2014291557.

Jan. 18, 2017 Office Action issued in Canadian Patent Application No. 2,916,040.

Jan. 10, 2017 Office Action issued in Korean Patent Application No. 10-2016-7002826.

Dec. 18, 2017 Office Action issued in Korean Patent Application No. 10-2016-7002826.

* cited by examiner

STEEL SHEET FOR CAN AND METHOD FOR MANUFACTURING THE SAME

TECHNICAL FIELD

This application is directed to a steel sheet for a can suitable for a can container material used for food cans and beverage cans and a method for manufacturing the same. In particular, the present disclosure relates to a steel sheet for a can exhibiting excellent drawability and buckling strength of a can body portion against an external pressure and a method for manufacturing the same. In this regard, the steel sheet for a can, according to the present disclosure is useful for application to a two-piece can.

BACKGROUND

From the viewpoints of environmental load reduction and cost reduction in recent years, reduction in usage of steel sheets used for food cans and beverage cans has been required, so that thickness reduction of a steel sheet has been advanced regardless of a two-piece can or a three-piece can. Associated with this, deformation of a can body due to external forces applied in the handling in can production and conveying steps and a market and buckling deformation of a can body portion due to fluctuation of the pressure in the inside of a can in heat sterilization of contents have been regarded as problems.

Conventionally, the strength of the steel sheet has been enhanced to improve the buckling deformation resistance of the can body portion. However, when the strength (YP) is increased by enhancing the strength of the steel sheet, the formability is degraded and a problem occurs in the can production step. That is, the formability is usually degraded by enhancing the strength of the steel sheet. As a result, there are problems that the incident of neck wrinkles and flange cracks increases in neck forming and the following flange forming performed after forming can body portion and a problem that an "ear" becomes large in drawing of a tow-piece can because of the anisotropy of the material. As described above, enhancement of the strength of the steel sheet is not always appropriate as a method for compensating degradation of the buckling deformation resistance associated with thickness reduction of the steel sheet.

On the other hand, the buckling phenomenon of the can body portion occurs due to degradation of the rigidity of the can body because of thickness reduction of the can body portion. Therefore, in order to improve the buckling deformation resistance, a method is considered, in which the rigidity is improved by increasing the Young's modulus of the steel sheet in itself. In particular, as for the tow-piece can, the circumferential direction of the can body after forming does not become a specific direction of the steel sheet and, therefore, the Young's modulus has to be improved uniformly in the steel sheet plane.

There is a strong interrelation between the Young's modulus of iron and the orientation. An orientation group (α-fiber) having the <110> direction, which is developed by rolling, parallel to the rolling direction particularly increases the Young's modulus in the direction at 90° to the rolling direction, and an orientation group (γ-fiber) having the <111> direction parallel to the direction of the normal to the sheet surface can increase the Young's moduli in the directions at 0°, 45°, and 90° to the rolling direction up to about 220 GPa. On the other hand, when the orientation of the steel sheet does not show alignment in a specific orientation, that is, the texture is random, the Young's modulus of the steel sheet is about 205 GPa.

For example, Patent Literature 1 discloses a steel sheet for a high-rigidity container, which is a rolled steel sheet containing, on a weight percent basis, C: 0.0020% or less, P: 0.05% or less, S: 0.008% or less, Al: 0.005% to 0.1%, N: 0.004% or less, 0.1% to 0.5% of at least one of Cr, Ni, Cu, Mo, Mn, and Si in total, and the balance being Fe and incidental impurities, which exhibits a microstructure having a ratio of a major axis to a minor axis of a crystal grain of 4 or more, and which has a maximum modulus of elasticity of 230,000 MPa or more. Furthermore, a method for enhancing the rigidity of the steel sheet is disclosed, wherein after a steel having the above-described chemical composition is cold rolled and is annealed, a strong rolling texture is formed by performing secondary cold rolling at a rolling reduction of 50% or more to increase the Young's modulus in the direction at 90° to the rolling direction.

Patent Literature 2 discloses a method for manufacturing a steel sheet for a container, wherein a steel containing, on a weight percent basis, C: 0.0020% or less, Mn: 0.5% or less, P: 0.02% or less, S: 0.008% or less, Al: 0.005% to 0.1%, N: 0.004% or less, and the balance being Fe and incidental impurities is subjected to common hot rolling and pickling, cold rolling at a rolling reduction of 60% or more is performed and, thereafter, annealing is not performed at all.

Patent Literature 3 discloses a method for manufacturing a steel sheet for a container, wherein a steel containing, on a weight ratio basis, C: 0.003% or less, Si: 0.1% or less, Mn: 0.4% or less, S: 0.015% or less, P: 0.02% or less, Al: 0.01% to 0.1%, N: 0.005% or less, and the balance being Fe and incidental impurities is hot rolled at a temperature of the $Ar_3$ transformation temperature or less under at least a total rolling reduction of 50% or more, pickling and cold rolling at 50% or more are performed and, thereafter, annealing is performed at 400° C. or higher and a recrystallization temperature or lower. A method for increasing the value of the maximum modulus of elasticity in the plane is disclosed, wherein a rolling texture is formed in accordance with an increase in the rolling reduction of cold rolling. In this regard, the recrystallization temperature here is defined as a temperature at which the degree of recrystallization becomes 10%, where a change in the texture associated with proceeding of the recrystallization is hardly observed.

Patent Literature 4 discloses a steel sheet for a high strength can, containing, on a percent by weight basis, C: 0.003% or less, Si: 0.02% or less, Mn: 0.05% to 0.60%, P: 0.02% or less, S: 0.02% or less, Al: 0.01% to 0.10%, N: 0.0010% to 0.0050%, Nb: 0.001% to 0.05%, B: 0.0005% to 0.002%, and the balance being Fe and incidental impurities, wherein in the sheet thickness center portion, (accumulation intensity of {112}<110> orientation/accumulation intensity of ({111}<112> orientation) 1.0 is held, the tensile strength in the direction at 90° to the rolling direction is 550 to 800 MPa, and the Young's modulus in the direction at 90° to the rolling direction is 230 GPa or more.

PATENT LITERATURE

PTL 1: Japanese Unexamined Patent Application Publication No. 6-212353

PTL 2: Japanese Unexamined Patent Application Publication No. 6-248332

PTL 3: Japanese Unexamined Patent Application Publication No. 6-248339

PTL 4: Japanese Unexamined Patent Application Publication No. 2012-107315

SUMMARY

Technical Problem

However, the following problems are mentioned in the above-described technologies in the related art. For example, Patent Literature 1 has a problem that the neck formability and the flange formability are degraded due to a large extent of secondary rolling at a rolling reduction of 50% or more. In addition, there is a problem that only the rolling texture is developed, the anisotropy is enhanced and, thereby, the drawability is degraded.

Patent Literature 2 has a problem that a steel as cold-rolled has excessively high strength and low ductility and, thereby, the deep drawability is inferior. In addition, there is a problem that the neck formability and the flange formability are degraded.

Patent Literature 3 has a problem that only the rolling texture is developed, the anisotropy is enhanced and, thereby, the drawability is degraded as with Patent Literature 1. Also, there is a problem that the ductility is low and the neck formability and the flange formability are low because annealing is performed at a temperature lower than the recrystallization temperature.

Patent Literature 4 has a problem that although the formability is obtained to the extent that is required of the three-piece can by recovery annealing, there is a problem that it cannot be applied to the uses, such as, two piece can, where severer formability is required.

It is an object of the present disclosure to solve the above-described problems in the related art and provide a steel sheet for a can exhibiting good drawability and excellent buckling strength of a can body portion against an external pressure while sufficient hardness is maintained and a method for manufacturing the same.

Solution to Problem

The present inventors conducted intensive research to solve the above-described issues. As a result, it was found that production of a steel sheet for a can having HR30T hardness of 56 or more, exhibiting excellent drawability, having an average Young's modulus of 210 GPa or more, and exhibiting excellent buckling strength of a can body portion against an external pressure was able to be realized by optimizing the chemical composition, the hot rolling condition, the cold rolling condition, and the annealing condition.

The disclosed embodiments include:

(1) A steel sheet for a can containing, on a percent by mass basis, C: 0.0030% or more and 0.0100% or less, Si: 0.05% or less, Mn: 0.10% or more and 1.0% or less, P: 0.030% or less, S: 0.020% or less, Al: 0.010% or more and 0.100% or less, N: 0.0050% or less, Nb: 0.010% or more and 0.050% or less, and the balance being of Fe and incidental impurities, contents of C and Nb satisfying Formula (1), HR30T hardness being 56 or more, and average Young's modulus being 210 GPa or more, $$0.10 \leq ([Nb]/92.9)/([C]/12) < 0.60 \quad \text{Formula (1)}$$

[Nb] and [C] represent the contents (percent by mass) of Nb and C, respectively.

(2) A steel sheet for a can containing, on a percent by mass basis, C: 0.0030% or more and 0.0100% or less, Si: 0.05% or less, Mn: 0.10% or more and 1.0% or less, P: 0.030% or less, S: 0.020% or less, Al: 0.010% or more and 0.100% or less, N: 0.0050% or less, Nb: 0.010% or more and 0.050% or less, and the balance being Fe and incidental impurities, contents of C and Nb satisfying Formula (1), HR30T hardness being 56 or more, average Young's modulus being 210 GPa or more, texture measured with respect to the plane at one-quarter the sheet thickness having an accumulation intensity of the orientation of $\phi_1$=30°, $\Phi$=55°, and $\phi_2$=45°, on an Euler angle expression of Bunge basis, being 6.0 or more and, an average accumulation intensity of the orientation of $\phi_1$=0°, $\Phi$=0° to 35°, and $\phi_2$=45° being 3.0 or more and 10.0 or less, $$0.10 \leq ([Nb]/92.9)/([C]/12) < 0.60 \quad \text{Formula (1)}$$

[Nb] and [C] represent the contents (percent by mass) of Nb and C, respectively.

(3) The steel sheet for a can, according to the above-described item (1) or item (2), wherein the steel sheet include ferrite having ferrite average grain size of less than 7 μm.

(4) The steel sheet for a can, according to any one of the above-described items (1) to (3), wherein the steel sheet further contains, on a percent by mass basis, at least one selected from Ti: 0.020% or less and Mo: 0.020% or less.

(5) A method for manufacturing a steel sheet for a can, including the steps of heating a steel slab having the chemical composition according to the above-described item (1) or item (2) at a heating temperature of 1,100° C. or higher, hot rolling at a finishing temperature of 800° C. to 950° C., coiling at a coiling temperature of 500° C. to 700° C., performing pickling, cold rolling at a rolling reduction of 85% or more, and annealing at a recrystallization temperature or higher.

(6) A method for manufacturing a steel sheet for a can, including the steps of heating a steel slab having the chemical composition according to the above-described item (1) or item (2) at a heating temperature of 1,100° C. or higher, hot rolling at a finishing temperature of 800° C. to 950° C., coiling at a coiling temperature of 500° C. to 700° C., performing pickling, cold rolling at a rolling reduction of 85% or more and 93% or less, and annealing at a recrystallization temperature or higher.

In this regard, in the present specification, every term "%" representing a component in the steel refers to "percent by mass".

Advantageous Effects

According to the present disclosure, a steel sheet for a can having HR30T hardness of 56 or more and an average Young's modulus with respect to the rolling direction, the direction at 45° to the rolling direction, and the direction at a right angle to the rolling direction of 210 GPa or more. Furthermore, when the steel sheet for a can according to the present disclosure is used, a can body having buckling strength of a can body portion against an external pressure higher than the reference value (about 1.5 kgf/cm$^2$) specified by can and beverage manufacturers can be produced easily. Therefore, according to the present disclosure, the rigidity of a can body used for food cans, beverage cans, and the like is improved, the thickness of the steel sheet can be further reduced, resource savings and cost reduction can be achieved and, thereby, industrial effects are exerted considerably.

Also, the steel sheet for a can, according to the present disclosure, exhibits good drawability while sufficient hardness is maintained and, in addition, excellent formability is exhibited in each of necking performed after can body portion forming and the following flange forming. The steel sheet for a can, according to the present disclosure, has good drawability required for forming a two-piece can and, in addition, is suitable for, in particular, the two-piece can because the Young's modulus in the steel sheet in-plane direction is high on the average and the buckling strength of a can body portion can be enhanced. This is because as for a container, e.g., a two-piece can, which includes drawing, any specific direction of the steel sheet does not become the can body direction after can production and, therefore, in order to enhance the buckling strength of the can body portion, the Young's modulus in the steel sheet in-plane direction has to be increased on the average.

Then, the range of application of the steel sheet according to the present disclosure is not limited to various metal cans and application to a wide range including cans furnished with dry batteries, various household electrical appliances and electric parts, automotive parts, and the like can be expected.

DETAILED DESCRIPTION

A steel sheet for a can, according to the disclosed embodiments, has a chemical composition containing, on a percent by mass basis, C: 0.0030% or more and 0.0100% or less, Si: 0.05% or less, Mn: 0.10% or more and 1.0% or less, P: 0.030% or less, S: 0.020% or less, Al: 0.010% or more and 0.100% or less, N: 0.0050% or less, Nb: 0.010% or more and 0.050% or less, and the balance being Fe and incidental impurities, where contents of C and Nb satisfy Formula (1), the HR30T hardness is 56 or more, and the average Young's modulus calculated with respect to the rolling direction, the direction at 45° to the rolling direction, and the direction at a right angle to the rolling direction is 210 GPa or more. In this regard, the steel sheet for a can, according to the present disclosure, can be produced by heating a steel slab having the above-described chemical composition at a heating temperature of 1,100° C. or higher, performing hot rolling at a finishing temperature of 800° C. to 950° C., performing coiling at a coiling temperature of 500° C. to 700° C., performing pickling, performing cold rolling at a rolling reduction of 85% or more, and performing annealing at a recrystallization temperature or higher.

To begin with, the chemical composition of the steel sheet for a can, according to the present disclosure, will be described.

C: 0.0030% or more and 0.0100% or less

Carbon is a particularly important element in the present disclosure. The hardness is increased by crystal grains being made fine due to NbC and solid solution C, and furthermore, a texture of (001) [1-10] to (112) [1-10] orientation ($\phi_1$=0°, $\Phi$=0° to 35°, and $\phi_2$=45°, on an Euler angle expression of Bunge basis), which is part of the $\alpha$-fiber) is developed to increase the Young's modulus. In order to obtain these effects, it is necessary that C be specified to be 0.0030% or more. In particular, from the viewpoint of an effect of increasing the hardness due to crystal grains being made fine, 0.0040% or more is preferable. On the other hand, if the C content is more than 0.0100%, a texture of (001) [1-10] to (112) [1-10] orientation is developed excessively and, in addition, a texture of (111) [1-21] orientation ($\phi_1$=30°, $\Phi$=55°, and $\phi_2$=45°, on an Euler angle expression of Bunge basis) is not developed, so that the average Young's modulus is reduced. Furthermore, the anisotropy is enhanced and, thereby, an ear becomes large in drawing and the drawability is degraded. For these reasons, the upper limit of C is specified to be 0.0100%. In particular, C is specified to be preferably 0.0080% or less from the viewpoint of improvement of the Young's modulus due to development of the texture of the (111) [1-21] orientation.

Nb: 0.010% or more and 0.050% or less

Niobium is an element having a most important role in the present disclosure together with C. That is, Nb has effects of making the microstructure of a hot rolled steel sheet fine and, in addition, forming NbC to make crystal grains of an annealed sheet fine through a pinning effect so as to contribute to an increase in the hardness. Also, Nb contributes to an increase in the hardness through precipitation strengthening of NbC in itself. At the same time, Nb contributes to development of the texture of the (111) [1-21] orientation and the (001) [1-10] to (112) [1-10] orientation by making crystal grains of the hot rolled steel sheet fine, so that the average Young's modulus increases. In order to obtain these effects, it is necessary that Nb be specified to be 0.010% or more. Furthermore, Nb is specified to be preferably 0.015% or more. On the other hand, if Nb is more than 0.050%, formation of NbC increases, solid solution C decreases, the texture of the (001) [1-10] to (112) [1-10] orientation is not developed, and the average Young's modulus is reduced. In addition, NbC is coarsened easily and the pinning effect is reduced, so that crystal grains of the annealed sheet become coarse and the hardness is reduced. Consequently, the upper limit of Nb is specified to be 0.050%, 0.040% or less is preferable, and 0.030% or less is further preferable.

$$0.10 \leq ([Nb]/92.9)/([C]/12) < 0.60$$

[Nb] and [C] represent the contents (percent by mass) of Nb and C, respectively

In the present disclosure, C and Nb can improve the hardness, the average Young's modulus, and the drawability suitable for a steel sheet for a can by specifying the respective contents to be within predetermined ranges and, in addition, adjusting the balance. When ([Nb]/92.9)/([C]/12) is smaller than 0.10, solid solution C becomes excessive, development of the texture of the (111) [1-21] orientation is hindered, and the average Young's modulus is reduced. In addition, the texture of the (001) [1-10] to (112) [1-10] orientation is developed excessively, and the ear in the drawing becomes large, so that the drawability is degraded. When ([Nb]/92.9)/([C]/12) is 0.60 or more, NbC is coarsened easily, and the pinning effect is reduced, so that crystal grains of the annealed sheet are coarsened and the hardness is reduced. In addition, solid solution C is reduced significantly, the texture of the (001) [1-10] to (112) [1-10] orientation is not developed, the balance of the anisotropy is changed, the ear in the drawing becomes large, so that the drawability is degraded. Consequently, it is necessary that C and Nb satisfy $0.10 \leq ([Nb]/92.9)/([C]/12) < 0.60$, and preferably $0.10 \leq ([Nb]/92.9)/([C]/12) < 0.40$.

Si: 0.05% or less

Addition of a large amount of Si degrades the surface treatability due to concentration on the steel sheet surface, and further degrades the corrosion resistance. Consequently, it is necessary that Si be specified to be 0.05% or less, and preferably 0.02% or less.

Mn: 0.10% or more and 1.0% or less

Manganese has an effect of improving the hardness of the steel sheet through solution strengthening and an effect of preventing degradation of the hot ductility resulting from S contained in the steel through formation of MnS. In order to obtain these effects, it is necessary that 0.10% or more of Mn be added. Furthermore, Mn lowers the $Ar_a$ transformation temperature and, thereby, crystal grains of the hot rolled steel sheet are made fine. Consequently, Mn contributes to development of the texture of the annealed sheet and has an effect of improving the average Young's modulus. From this point of view, it is preferable that Mn is specified to be 0.25% or more. On the other hand, when Mn is more than 1.0%, the texture is not developed easily in the annealing and, in particular, the (111) [1-21] orientation is reduced, so that the average Young's modulus is reduced. Therefore, the upper limit of Mn is specified to be 1.0%, and 0.60% or less is preferable.

P: 0.030% or less

Addition of a large amount of P degrades the formability because of the steel sheet becoming excessively hard and central segregation and further degrades the corrosion resistance. Consequently, the upper limit of P is specified to be 0.030%, and 0.020% or less is preferable.

S: 0.020% or less

Sulfur forms sulfides in the steel and degrades the hot ductility. Therefore, the upper limit of S is specified to be 0.020% or less, and 0.015% or less is preferable.

Al: 0.010% or more and 0.100% or less

Aluminum is an element which is added as a deoxidizing agent. Also, Al has effects of reducing solid solution N in the steel by forming AlN through bonding with N and improving the drawability and the anti-aging property. In order to obtain these effects, it is necessary that 0.010% or more of Al be added. If Nb nitrides are generated, an effective amount of Nb decreases. Therefore, it is preferable that AlN be generated on a priority basis. From this point of view, it is preferable that Al be specified to be 0.050% or more. If addition is excessive, not only the above-described effects are saturated but also the production cost increases. Meanwhile, problems occur, for example, inclusions, e.g., alumina, increase and the drawability is degraded. Consequently, the upper limit of Al is 0.100%.

N: 0.0050% or less

Preferably, N is minimized because N bonds with Al, Nb, and the like to form nitrides and carbonitrides and hinders the hot ductility. Meanwhile, addition of a large amount impairs development of the texture and the average Young's modulus is reduced. Consequently, it is necessary that the upper limit be specified to be 0.0050%. On the other hand, it is difficult to allow N to become less than 0.0010% stably and the production cost increases. Therefore, N is preferably 0.0010% or more.

The remainder is composed of Fe and incidental impurities.

In addition to the above-described chemical composition, in the present disclosure, the following elements can be added.

At least one selected from Ti: 0.020% or less and Mo: 0.020% or less

Titanium and molybdenum are elements to form carbides and have an effect of contributing to improvement of hardness by making crystal grains of the annealed sheet fine through the pinning effect. Not only precipitation strengthening of Ti or Mo carbide in itself contributes to an increase in the hardness but also effects of making crystal grains of the annealed sheet fine and increasing the hardness can be enhanced by formation of complex carbide with Nb, which is not coarsened easily. In the case of addition, Ti: 0.005% or more and Mo: 0.005% or more are preferable in order to obtain these effects reliably. On the other hand, when addition is excessive, solid solution C is reduced, the texture of the (001) [1-10] to (112) [1-10] orientation is not developed, and the average Young's modulus is reduced. Consequently, When Ti and Mo are added, Ti: 0.020% or less and Mo: 0.020% or less are employed. From the viewpoint of development of the texture of the (111) [1-21] orientation and suppression of coarsening of carbides, it is preferable that the following formula be satisfied.

$$0.10 \leq ([Nb]/92.9)+[Ti]/47.9+[Mo]/95.4)/([C]/12) \leq 2.0$$

[Nb], [Ti], [Mo], and [C] represent the contents (percent by mass) of Nb, Ti, Mo, and C, respectively.

Next, the material characteristics will be described.

HR30T hardness: 56 or more

In order to prevent plastic deformation when a load is applied by falling of a can, stacking of cans, carrying in an automatic vending machine, and the like, it is necessary to make a steel sheet hard. Consequently, the Rockwell superficial hardness (scale 30T, HR30T) of 56 or more is required, and 58 or more is preferable. When the hardness is too large, the formability is degraded and, therefore, 63 or less is preferable. The measuring method will be described later with reference to the example in detail. In the step of hot rolling of a steel having the above-described chemical composition, the microstructure of the hot rolled steel sheet is made fine by employing the finishing temperature and the coiling temperature within predetermined ranges. Cold rolling is performed at a predetermined rolling reduction and annealing is performed at the recrystallization temperature or higher, so that coarsening of NbC is suppressed while crystal grains of the annealed sheet is made fine. In this manner, the HR30T hardness of 56 or more can be ensured.

Average Young's modulus: 210 GPa or more

The average Young's modulus is a particularly important requirement in the present disclosure. As for a container, e.g., a two-piece can, which includes drawing, any specific direction of the steel sheet does not become the can body circumferential direction after can production. Therefore, the buckling strength of the can body portion can be enhanced by increasing the Young's modulus in the steel sheet in-plane direction on the average. In the present disclosure, the average Young's modulus is calculated from the Young's modulus in the rolling direction (E[L]), the Young's modulus in the direction at 45° to the rolling direction (E[D]), and the Young's modulus in the direction at a right angle to the rolling direction (E[C]) on the basis of (E[L]+2E[D]+E[C])/4.

An effect of enhancing the buckling strength of the can body portion is obtained by specifying the average Young's modulus to be 210 GPa or more, and preferably 215 GPa or more. The measuring method will be described later with reference to the example in detail. In the method for specifying the average Young's modulus to be within such a range, it is preferable that the texture be developed into the state described below. That is, the steel composition is specified to be within the predetermined range, in particular the balance between C and Nb is controlled, and the finishing temperature and the coiling temperature are controlled in the hot rolling step, so that development of the texture in the cold rolling and annealing step is facilitated, cold rolling at 85% or more and recrystallization annealing are performed and, thereby, the predetermined texture is obtained.

As for texture with respect to plane at one-quarter sheet thickness, accumulation intensity of orientation of $\phi_1$=30°, $\Phi$=55°, and $\phi_2$=45° on an Euler angle expression of Bunge basis: 6.0 or more and average accumulation intensity of orientation of $\phi_1$=0°, $\Phi$=0° to 35°, and $\phi_2$=45°:3.0 or more and 10.0 or less In the disclosed embodiments, the Young's modulus is increased by controlling the texture, so that an effect of enhancing the buckling strength of the can body portion is obtained. In addition, generation of an ear can be suppressed in the drawing and the drawability can be improved. The (111) [1-21] orientation (orientation of $\phi_1$=30°, Φ=55°, and $\phi_2$=45° on an Euler angle expression of Bunge basis) is an orientation effective in increasing the average Young's modulus, and the accumulation intensity of 6.0 or more is preferable, and 8.0 or more is further preferable. The (001) [1-10] to (112) [1-10] orientation (orientation of $\phi_1$=0°, Φ=0° to 35°, and $\phi_2$=45° on an Euler angle expression of Bunge basis) has an effect of increasing the average Young's modulus particularly by increasing the Young's modulus in the direction at a right angle to the rolling direction and, in addition, can suppress generation of an ear in the drawing and improve the drawability by developing the texture at the same time with the (111) [1-21] orientation. Consequently, the average accumulation intensity of the (001) [1-10] to (112) [1-10] orientation is specified to be preferably 3.0 or more, and further preferably 6.0 or more. On the other hand, when the texture of the (001) [1-10] to (112) [1-10] orientation is developed excessively, the balance of the anisotropy is changed and, conversely, a large ear is generated, so that 10.0 or less is preferable. In general, the texture is changed depending on the position in the sheet thickness. In the present disclosure, a good interrelation between the measurement value with respect to the plane at one-quarter sheet thickness and the Young's modulus or the formability is obtained and, therefore, the measurement position is specified to be the plane at one-quarter sheet thickness.

Ferrite average grain size: less than 7 μm (suitable condition)

When the ferrite average grain size of the annealed sheet is specified to be less than 7 μm, predetermined hardness is obtained easily, an effect of preventing plastic deformation when a load during carrying and the like is applied is further exerted. Moreover, when a laminated steel sheet in which the steel sheet surface is coated with an organic coating is produced, surface roughness in can production forming is suppressed by making the ferrite average grain size fine, the adhesion of the organic coating is improved, and good corrosion resistance is obtained. Therefore, the ferrite average grain size is preferably less than 7 μm, and more preferably less than 6.5 μm.

Next, one example of the manufacturing method for obtaining a steel sheet for a can having HR30T hardness of 56 or more and exhibiting good drawability and excellent buckling strength of the can body portion against an external pressure, according to the present disclosure, will be described.

The steel sheet for a can according to the present disclosure is produced by heating a steel slab having the above-described chemical composition at a heating temperature of 1,100° C. or higher, performing hot rolling at a finishing temperature of 800° C. to 950° C., performing coiling at a coiling temperature of 500° C. to 700° C., performing pickling, performing cold rolling at a rolling reduction of 85% or more, and performing annealing at a recrystallization temperature or higher.

Heating temperature before hot rolling: 1,100° C. or higher

If the heating temperature before the hot rolling is too low, coarse NbC remains, so that an effect of making crystal grains fine and an effect of increasing the hardness through precipitation strengthening are not obtained easily. Therefore, the heating temperature before the hot rolling is specified to be 1,100° C. or higher. If the heating temperature is too high, scale is generated excessively and becomes defects of the product surface easily. Therefore, 1,300° C. or lower is preferable.

Hot rolling finish temperature 800° C. to 950° C.

If the hot rolling finish rolling temperature is higher than 950° C., crystal grains of the hot rolled sheet are coarsened, development of the texture is hindered and, in addition, crystal grains of the annealed sheet are coarsened, so that the hardness is reduced. If the hot rolling finish rolling temperature is lower than 800° C., rolling is performed at a transformation temperature or lower, and the texture is not developed easily because of generation of coarse grains and remaining of a worked microstructure. Therefore, the hot rolling finish rolling temperature is specified to be 800° C. to 950° C., and preferably 850° C. to 950° C.

Coiling temperature after hot rolling 500° C. to 700° C. If the coiling temperature after the hot rolling is higher than 700° C., NbC is coarsened and the pinning effect is reduced. In addition, crystal grains of the annealed sheet are coarsened because crystal grains of the hot rolled sheet are coarsened, so that the hardness is reduced. Furthermore, the development of the texture is hindered because crystal grains of the hot rolled sheet are coarsened, so that the average Young's modulus is reduced. For the above-described reasons, the coiling temperature after the hot rolling is specified to be 700° C. or lower, and preferably 650° C. or lower. In the case where the coiling temperature is too low, precipitation of NbC does not occur sufficiently, the pinning effect is reduced, and precipitation strengthening is reduced, so that the hardness of the annealed sheet is reduced. Also, solid solution C becomes excessive, so that development of the texture of the (111) [1-21] orientation is hindered and the average Young's modulus is reduced, the texture of the (001) [1-10] to (112) [1-10] orientation is developed excessively and the balance of the anisotropy is degraded and, thereby, the drawability in the drawing is degraded. Consequently, the coiling temperature after the hot rolling is specified to be 500° C. or higher, and preferably 530° C. or higher.

The pickling condition is not particularly specified insofar as surface layer scale can be removed. Pickling can be performed by a common method.

Rolling reduction of cold rolling: 85% or more

The rolling reduction of the cold rolling is specified to be 85% or more in order to improve the average Young's modulus through development of the texture and achieve the HR30T hardness of 56 or more. If the rolling reduction is less than 85%, the texture is not developed sufficiently, and the average Young's modulus is reduced. In addition, crystal grains are coarsened and the predetermined hardness is not obtained. From the viewpoint of development of the texture, 88% or more is preferable. If the rolling reduction of the cold rolling is too high, the anisotropy becomes too large, and the drawability is degraded, so that 93% or less is preferable, and less than 90% is more preferable.

Annealing temperature: recrystallization temperature or higher

From the viewpoint of control of the texture and improvement of the drawability, the annealing temperature is specified to be recrystallization temperature or higher. From the viewpoint of development of the texture due to grain growth, it is preferable to perform soaking at 710° C. or higher for 10 s or more, and 740° C. or higher is further preferable. If the temperature is too high, crystal grains are coarsened and NbC is also coarsened, so that the hardness is reduced. Therefore, the annealing temperature is specified to be preferably 800° C. or lower. The annealing method is not limited, although a continuous annealing method is preferable from the viewpoint of the homogeneity of the material. The recrystallization temperature in the present disclosure refers to the temperature at which recrystallization proceeds sufficiently, and specifically the temperature at which the degree of recrystallization becomes 99% or more on an area ratio basis.

Rolling Reduction of Temper Rolling

Preferably, the steel sheet after the annealing is subjected to temper rolling from the viewpoint of shape correction and adjustment of the surface roughness and the hardness. The rolling is performed at a rolling reduction of preferably 0.5% or more from the viewpoint of suppressing generation of a stretcher strain. On the other hand, if rolling is performed at a reduction ratio of more than 5.0%, the steel sheet is made hard and the drawability is degraded. In addition, the anisotropy is enhanced and the ear in the drawing is made large. Consequently, the rolling reduction of the temper rolling is specified to be preferably 5.0% or less, and further preferably 0.7% to 3.5%.

As for the surface treatment of the steel sheet, Sn coating, Ni coating, Cr coating, or the like may be applied. Furthermore, a chemical conversion treatment or an organic coating, e.g., a laminate, may be applied.

The sheet thickness of the steel sheet according to the present disclosure is not limited, although 0.25 mm or less is preferable from the viewpoint of the thickness reduction. Meanwhile, if the sheet thickness is too small, the buckling strength of a can body portion is reduced easily.

Therefore, the sheet thickness is specified to be preferably 0.16 mm or more.

In this manner, the steel sheet for a can having HR30T hardness of 56 or more and exhibiting good drawability and excellent buckling strength of the can body portion against an external pressure, according to the present disclosure, is obtained.

Example 1

Steels containing components of Steel symbols A to V shown in Table 1 and the balance being Fe and incidental impurities were melted and refined to obtain steel slabs. The resulting steel slabs were subjected to heating, hot rolling, pickling to remove scale, and cold rolling under the conditions shown in Table 2. Subsequently, steel sheets (Steel sheet symbols 1 to 32) having a sheet thickness of 0.220 mm were obtained by applying soaking at the respective annealing temperatures for 20 s in a continuous annealing furnace, cooling, and temper rolling. The thus obtained steel sheets were subjected to characteristic evaluations by the methods described below.

TABLE 1

| Steel symbol | C mass % | Si mass % | Mn mass % | P mass % | S mass % | Al mass % | N mass % | Nb mass % | Others mass % | (Nb/92.9)/(C/12) | (Nb/92.9 + Ti/47.9 + Mo/95.9)/(C/12) |
|---|---|---|---|---|---|---|---|---|---|---|---|
| A | 0.0060 | 0.01 | 0.50 | 0.010 | 0.008 | 0.060 | 0.0030 | 0.016 | — | 0.34 | — |
| B | 0.0030 | 0.01 | 0.60 | 0.010 | 0.010 | 0.020 | 0.0030 | 0.012 | — | 0.52 | — |
| C | 0.0100 | 0.01 | 0.10 | 0.020 | 0.005 | 0.060 | 0.0010 | 0.040 | — | 0.52 | — |
| D | 0.0050 | 0.02 | 0.65 | 0.015 | 0.012 | 0.050 | 0.0020 | 0.014 | — | 0.36 | — |
| E | 0.0080 | 0.01 | 0.60 | 0.010 | 0.012 | 0.060 | 0.0030 | 0.015 | — | 0.24 | — |
| F | 0.0060 | 0.05 | 0.40 | 0.010 | 0.011 | 0.080 | 0.0040 | 0.010 | — | 0.22 | — |
| G | 0.0060 | 0.01 | 0.26 | 0.010 | 0.010 | 0.050 | 0.0030 | 0.016 | — | 0.34 | — |
| H | 0.0060 | 0.01 | 1.00 | 0.010 | 0.011 | 0.050 | 0.0030 | 0.026 | — | 0.56 | — |
| I | 0.0050 | 0.01 | 0.30 | 0.030 | 0.010 | 0.060 | 0.0020 | 0.020 | — | 0.52 | — |
| J | 0.0070 | 0.01 | 0.50 | 0.008 | 0.010 | 0.060 | 0.0030 | 0.020 | — | 0.37 | — |
| K | 0.0080 | 0.01 | 0.60 | 0.010 | 0.015 | 0.050 | 0.0030 | 0.025 | — | 0.40 | — |
| L | 0.0050 | 0.01 | 0.30 | 0.010 | 0.010 | 0.090 | 0.0020 | 0.020 | — | 0.52 | — |
| M | 0.0015 | 0.01 | 0.40 | 0.010 | 0.010 | 0.060 | 0.0030 | 0.020 | — | 1.72 | — |
| N | 0.0400 | 0.01 | 0.45 | 0.010 | 0.012 | 0.020 | 0.0030 | 0.025 | — | 0.08 | — |
| O | 0.0050 | 0.01 | 1.50 | 0.010 | 0.010 | 0.060 | 0.0025 | 0.020 | — | 0.52 | — |
| P | 0.0060 | 0.01 | 0.50 | 0.015 | 0.013 | 0.070 | 0.0040 | 0.004 | — | 0.09 | — |
| Q | 0.0040 | 0.01 | 0.55 | 0.010 | 0.010 | 0.050 | 0.0030 | 0.080 | — | 2.58 | — |
| R | 0.0040 | 0.01 | 0.60 | 0.010 | 0.012 | 0.050 | 0.0030 | 0.040 | — | 1.29 | — |
| S | 0.0055 | 0.01 | 0.45 | 0.010 | 0.009 | 0.055 | 0.0030 | 0.016 | Ti: 0.006 | 0.38 | 0.65 |
| T | 0.0055 | 0.01 | 0.40 | 0.012 | 0.010 | 0.060 | 0.0022 | 0.013 | Mo: 0.015 | 0.31 | 0.65 |
| U | 0.0060 | 0.01 | 0.50 | 0.010 | 0.008 | 0.060 | 0.0030 | 0.018 | Ti: 0.013, Mo: 0.01 | 0.39 | 1.14 |
| V | 0.0044 | 0.01 | 0.35 | 0.012 | 0.009 | 0.055 | 0.0026 | 0.025 | — | 0.73 | — |

TABLE 2

| Steel sheet symbol | Steel symbol | Heating temperature ° C. | Finishing temperature ° C. | Coiling temperature ° C. | Rolling reduction of cold rolling % | Annealing temperature ° C. | Rolling reduction of temper rolling % |
|---|---|---|---|---|---|---|---|
| 1 | A | 1200 | 890 | 560 | 89 | 750 | 2.0 |
| 2 | A | 1080 | 880 | 550 | 89 | 750 | 2.0 |
| 3 | A | 1280 | 970 | 650 | 89 | 750 | 2.0 |
| 4 | A | 1180 | 780 | 550 | 90 | 740 | 1.5 |
| 5 | A | 1200 | 860 | 730 | 90 | 740 | 2.0 |
| 6 | A | 1200 | 860 | 490 | 90 | 760 | 2.5 |
| 7 | A | 1220 | 890 | 580 | 81 | 750 | 3.0 |
| 8 | A | 1150 | 900 | 560 | 90 | 670 | 2.0 |
| 9 | A | 1200 | 920 | 560 | 89 | 880 | 2.0 |
| 10 | B | 1250 | 890 | 560 | 89 | 750 | 1.0 |

TABLE 2-continued

| Steel sheet symbol | Steel symbol | Heating temperature ° C. | Finishing temperature ° C. | Coiling temperature ° C. | Rolling reduction of cold rolling % | Annealing temperature ° C. | Rolling reduction of temper rolling % |
|---|---|---|---|---|---|---|---|
| 11 | C | 1220 | 930 | 630 | 85 | 780 | 2.0 |
| 12 | D | 1200 | 890 | 580 | 89 | 750 | 2.0 |
| 13 | E | 1200 | 890 | 560 | 89 | 750 | 2.0 |
| 14 | F | 1180 | 890 | 600 | 89 | 710 | 2.0 |
| 15 | G | 1200 | 890 | 530 | 91 | 750 | 1.5 |
| 16 | H | 1200 | 850 | 560 | 89 | 750 | 2.0 |
| 17 | I | 1200 | 890 | 560 | 90 | 750 | 2.0 |
| 18 | J | 1200 | 890 | 550 | 89 | 750 | 1.5 |
| 19 | K | 1200 | 890 | 560 | 89 | 760 | 1.2 |
| 20 | L | 1230 | 890 | 560 | 89 | 750 | 2.0 |
| 21 | M | 1200 | 890 | 560 | 89 | 750 | 2.0 |
| 22 | N | 1200 | 890 | 560 | 89 | 750 | 2.0 |
| 23 | O | 1200 | 890 | 560 | 89 | 750 | 2.0 |
| 24 | P | 1200 | 890 | 560 | 89 | 750 | 2.0 |
| 25 | Q | 1200 | 890 | 640 | 89 | 750 | 2.0 |
| 26 | R | 1200 | 890 | 560 | 89 | 750 | 2.0 |
| 27 | S | 1200 | 890 | 540 | 88 | 750 | 1.5 |
| 28 | T | 1200 | 890 | 580 | 88 | 750 | 2.0 |
| 29 | U | 1240 | 900 | 560 | 89 | 750 | 2.0 |
| 30 | A | 1200 | 890 | 560 | 89 | 750 | 0.7 |
| 31 | A | 1170 | 880 | 600 | 89 | 700 | 2.0 |
| 32 | V | 1200 | 900 | 610 | 89 | 750 | 1.8 |

As for the ferrite average grain size, the ferrite microstructure of a cross-section in the rolling direction was etched with a 3% nital solution to expose grain boundaries, and average grain size was measured by using a photograph taken with an optical microscope at the magnification of 400 times and by an intercept method in conformity with JIS G 0551 Steels-Micrographic determination of the apparent grain size and was taken as the ferrite average grain size.

The optical micrograph for measurement of the ferrite average grain size was used, and the area ratio of the recrystallized region was determined on the basis of image processing and was taken as the degree of recrystallization. The case where the degree of recrystallization was 99% or more was rated as recrystallization and was indicated by ○, and the case of less than 99% was rated as unrecrystallization and was indicated by x.

As for evaluation of the average Young's modulus, test pieces of 10 mm×35 mm were cut, where the longitudinal directions were specified to be the direction at 0°, 45°, and 90° to the rolling direction, a transverse vibration resonance frequency measurement device was used, the Young's modulus (GPa) in each direction was measured in conformity with the standards of American Society to Testing Materials (C1259), and the average Young's modulus was calculated on the basis of (E[L]+2E[D]+E[C])/4.

The Rockwell superficial 30T hardness (HR30T) at the position specified in JIS G 3315 was measured in conformity with JIS Z 2245 Rockwell hardness test method.

As for the texture with respect to the plane at one-quarter the sheet thickness, the accumulation intensity of the orientation of $\phi_1$=30°, Φ=55°, and $\phi_2$=45° on an Euler angle expression of Bunge basis and the average accumulation intensity of the orientation of $\phi_1$=0°, Φ=0° to 35°, and $\phi_2$=45° were evaluated by measuring a pole figure on the basis of X-ray diffraction and calculating the orientation distribution function (ODF). The thickness was reduced to one-quarter sheet thickness portion by mechanical polishing and chemical polishing with oxalic acid to remove the effect of working strain, and (110), (200), (211), and (222) pole figures were formed by the Shultz reflection method. The ODF was calculated from these pole figures by the series expansion method, the orientation of $\phi_1$=30°, Φ=55°, and $\phi_2$=45° on an Euler angle expression of Bunge basis was evaluated and an arithmetic average of the values of the ODF of the orientation of $\phi_1$=0°, Φ=0° to 35°, and $\phi_2$=45° was evaluated as the average accumulation intensity.

Furthermore, in order to evaluate the drawability and the buckling strength of the can body, a laminated steel sheet, in which the above-described steel sheet was subjected to a chromium coating (tin free) treatment as a surface treatment and was covered with an organic coating, was produced.

In order to evaluate the drawability, punching into a circular shape having a diameter of 180 mm was performed, cylindrical deep drawing was performed at a drawing ratio of 1.6, and the ear height (height of the can body portion of entire circumference of the can) was measured. The earing ratio was calculated by dividing the difference between the maximum value and the minimum value of the ear height by the average value of the height of the entire circumference, the case of 3% or less was rated as good (○), and the case of more than 3% was rated as poor (x).

In order to evaluate the buckling strength of the can body portion of the steel sheet exhibiting good drawability, the above-described laminated steel sheet was punched into a circular shape and was subjected to deep drawing, ironing, and the like, so that a can body similar to a two-piece can for application to beverage cans was formed and was subjected to the measurement. The measuring method was as described below. The can body was placed in the inside of a pressure chamber, and pressurization of the inside of the pressure chamber was performed by introducing pressurized air at 0.016 MPa/s into the chamber through an air introduction valve. The pressure in the inside of the chamber was examined through a pressure gauge, a pressure sensor, an amplifier to amplify the detection signal thereof, and a signal processing device to perform display of the detection signal, data processing, and the like. The buckling pressure was defined as a pressure at a point of pressure change associated with buckling. In general, it is believed that external pressure strength of 0.15 MPa or more is necessary against the pressure change due to heat sterilization. Therefore, the case where the external pressure strength was higher than 0.15

MPa was indicated by ○, and the case where the external pressure strength was 0.15 MPa or less was indicated by x. In this regard, the steel sheet exhibiting poor drawability was not subjected to evaluation of the buckling strength of the can body portion and was indicated by -.

TABLE 3

| Steel sheet symbol | Average grain size μm | Degree of recrystallization % | HR30T hardness | Average Young's modulus GPa | Accumulation intensity of $\varphi_1$ = 30° $\Phi$ = 55° $\varphi_2$ = 45° orientation | Average accumulation intensity of $\varphi_1$ = 0° $\Phi$ = 0-35° $\varphi_2$ = 45° orientation | Draw-ability evaluation | Buckling strength evaluation | Remarks |
|---|---|---|---|---|---|---|---|---|---|
| 1 | 6.2 | ○ | 58 | 215 | 7.0 | 8.2 | ○ | ○ | Invention example |
| 2 | 7.9 | ○ | 53 | 204 | 5.5 | 6.3 | ○ | x | Comparative example |
| 3 | 7.6 | ○ | 54 | 203 | 5.1 | 6.6 | x | — | Comparative example |
| 4 | 7.5 | ○ | 57 | 203 | 4.6 | 11.3 | x | — | Comparative example |
| 5 | 9.3 | ○ | 54 | 205 | 5.6 | 7.3 | x | — | Comparative example |
| 6 | 7.6 | ○ | 52 | 203 | 4.5 | 8.8 | ○ | x | Comparative example |
| 7 | 8.1 | ○ | 55 | 202 | 4.1 | 7.2 | ○ | x | Comparative example |
| 8 | 6.4 | x | 68 | 201 | 4.3 | 11.1 | x | — | Comparative example |
| 9 | 10.3 | ○ | 56 | 211 | 7.2 | 4.2 | ○ | ○ | Invention example |
| 10 | 6.4 | ○ | 56 | 212 | 7.4 | 7.9 | ○ | ○ | Invention example |
| 11 | 5.1 | ○ | 63 | 214 | 8.0 | 8.6 | ○ | ○ | Invention example |
| 12 | 6.3 | ○ | 57 | 216 | 7.1 | 8.4 | ○ | ○ | Invention example |
| 13 | 6.0 | ○ | 59 | 213 | 6.8 | 8.4 | ○ | ○ | Invention example |
| 14 | 6.6 | ○ | 58 | 213 | 6.3 | 9.0 | ○ | ○ | Invention example |
| 15 | 6.7 | ○ | 56 | 211 | 6.4 | 5.4 | ○ | ○ | Invention example |
| 16 | 5.6 | ○ | 60 | 217 | 9.8 | 6.2 | ○ | ○ | Invention example |
| 17 | 6.6 | ○ | 57 | 215 | 8.6 | 6.5 | ○ | ○ | Invention example |
| 18 | 5.9 | ○ | 59 | 216 | 7.6 | 6.6 | ○ | ○ | Invention example |
| 19 | 5.6 | ○ | 60 | 213 | 6.7 | 8.0 | ○ | ○ | Invention example |
| 20 | 6.4 | ○ | 58 | 219 | 9.5 | 4.4 | ○ | ○ | Invention example |
| 21 | 8.8 | ○ | 53 | 213 | 10.3 | 2.6 | x | — | Comparative example |
| 22 | 6.1 | ○ | 60 | 206 | 4.6 | 6.3 | ○ | x | Comparative example |
| 23 | 5.7 | ○ | 54 | 202 | 5.1 | 7.3 | ○ | x | Comparative example |
| 24 | 7.4 | ○ | 52 | 201 | 4.3 | 6.6 | ○ | x | Comparative example |
| 25 | 10.3 | ○ | 53 | 212 | 9.5 | 2.3 | x | — | Comparative example |
| 26 | 7.4 | ○ | 58 | 213 | 8.6 | 2.4 | x | — | Comparative example |
| 27 | 5.9 | ○ | 61 | 216 | 8.1 | 6.3 | ○ | ○ | Invention example |
| 28 | 5.8 | ○ | 60 | 218 | 9.3 | 7.5 | ○ | ○ | Invention example |
| 29 | 5.6 | ○ | 62 | 218 | 10.3 | 6.2 | ○ | ○ | Invention example |
| 30 | 6.2 | ○ | 57 | 215 | 7.0 | 8.2 | ○ | ○ | Invention example |
| 31 | 6.5 | x | 64 | 206 | 5.2 | 10.7 | x | — | Comparative example |
| 32 | 7.3 | ○ | 54 | 208 | 8.6 | 2.6 | x | — | Comparative example |

The results are shown in Table 3. In every inventive example, the HR30T was 56 or more, the average Young's modulus was 210 GPa or more, and excellent formability and buckling strength of the can body were exhibited. In addition, the ferrite average grain size was less than 7 μm, the adhesion of the organic coating applied was good, and the corrosion resistance was excellent. On the other hand, as for the comparative example, at least one of the above-described characteristics was poor.

The invention claimed is:

1. A steel sheet for a can, the steel sheet comprising:
C: 0.0030% or more and 0.0100% or less, by mass %;
Si: 0.05% or less, by mass %;
Mn: 0.25% or more and 1.0% or less, by mass %;
P: 0.030% or less, by mass %;
S: 0.020% or less, by mass %;
Al: 0.010% or more and 0.100% or less, by mass %;
N: 0.0050% or less, by mass %;
Nb: 0.010% or more and 0.050% or less, by mass %; and
Fe and incidental impurities,
wherein:
the contents of C and Nb satisfy Formula (1):

$$0.10 \leq ([Nb]/92.9)/([C]/12) \leq 0.37 \quad \text{Formula (1)},$$

[Nb] and [C] represent the contents (mass %) of Nb and C, respectively,
the steel sheet has a HR30T hardness of 56 or more, and
the steel sheet has an average Young's modulus of 210 GPa or more.

2. A steel sheet for a can, the steel sheet comprising:
C: 0.0030% or more and 0.0100% or less, by mass %;
Si: 0.05% or less, by mass %;
Mn: 0.25% or more and 1.0% or less, by mass %;
P: 0.030% or less, by mass %;
S: 0.020% or less, by mass %;
Al: 0.010% or more and 0.100% or less, by mass %;
N: 0.0050% or less, by mass %;
Nb: 0.010% or more and 0.050% or less, by mass %; and
Fe and incidental impurities,
wherein:
the contents of C and Nb satisfy Formula (1):

$$0.10 \leq ([Nb]/92.9)/([C]/12) \leq 0.37 \quad \text{Formula (1)},$$

[Nb] and [C] represent the contents (mass %) of Nb and C, respectively,
the steel sheet has a HR30T hardness of 56 or more,
the steel sheet has an average Young's modulus of 210 GPa or more,
texture measured with respect to the plane at one-quarter of the sheet thickness has an accumulation intensity of the orientation of $\phi_1$=30°, $\Phi$=55°, and $\phi_2$=45°, on an Euler angle expression of Bunge basis, of 6.0 or more, and an average accumulation intensity of the orientation of $\phi_1$=0°, $\Phi$=0° to 35°, and $\phi_2$=45° of 3.0 or more and 10.0 or less.

3. The steel sheet for a can, according to claim 1, wherein the steel sheet includes ferrite having ferrite average grain size of less than 7 μm.

4. The steel sheet for a can, according to claim 1, wherein the steel sheet further comprises at least one selected from the group consisting of Ti: 0.020% or less, by mass % and Mo: 0.020% or less, by mass %.

5. A method for manufacturing the steel sheet for a can according to claim 1, the method comprising:

heating a steel slab at a heating temperature of 1,100° C. or higher, hot rolling the steel slab at a finishing temperature of 800° C. to 950° C. to produce a hot rolled steel sheet, coiling the hot rolled steel sheet at a coiling temperature of 500° C. to 700° C. to produce a coiled steel sheet, performing pickling of the coiled steel sheet, after pickling, cold rolling the steel sheet at a rolling reduction of 85% or more, and annealing the steel sheet at a recrystallization temperature or higher.

6. A method for manufacturing the steel sheet for a can according to claim 1, the method comprising:

heating a steel slab at a heating temperature of 1,100° C. or higher, hot rolling the steel slab at a finishing temperature of 800° C. to 950° C. to produce a hot rolled steel sheet, coiling the hot rolled steel sheet at a coiling temperature of 500° C. to 700° C. to produce a coiled steel sheet, pickling the coiled steel sheet, after pickling, cold rolling the steel sheet at a rolling reduction of 85% or more and 93% or less, and annealing the steel sheet at a recrystallization temperature or higher.

7. The steel sheet for a can, according to claim 2, wherein the steel sheet includes ferrite having ferrite average grain size of less than 7 μm.

8. The steel sheet for a can, according to claim 2, wherein the steel sheet further comprises at least one selected from the group consisting of Ti: 0.020% or less, by mass % and Mo: 0.020% or less, by mass %.

9. A method for manufacturing the steel sheet for a can according to claim 2, the method comprising:

heating a steel slab at a heating temperature of 1,100° C. or higher, hot rolling the steel slab at a finishing temperature of 800° C. to 950° C. to produce a hot rolled steel sheet, coiling the hot rolled steel sheet at a coiling temperature of 500° C. to 700° C. to produce a coiled steel sheet, performing pickling of the coiled steel sheet, after pickling, cold rolling the steel sheet at a rolling reduction of 85% or more, and annealing the steel sheet at a recrystallization temperature or higher.

10. A method for manufacturing the steel sheet for a can according to claim 2, the method comprising:

heating a steel slab at a heating temperature of 1,100° C. or higher, hot rolling the steel slab at a finishing temperature of 800° C. to 950° C. to produce a hot rolled steel sheet, coiling the hot rolled steel sheet at a coiling temperature of 500° C. to 700° C. to produce a coiled steel sheet, pickling the coiled steel sheet, after pickling, cold rolling the steel sheet at a rolling reduction of 85% or more and 93% or less, and annealing the steel sheet at a recrystallization temperature or higher.

11. The steel sheet for a can, according to claim 1, wherein the steel sheet includes C in the range from 0.0040% to 0.0080%, by mass %.

12. The steel sheet for a can, according to claim 2, wherein the steel sheet includes C in the range from 0.0040% to 0.0080%, by mass %.

13. The steel sheet for a can, according to claim 1, wherein the steel sheet includes Nb in the range from 0.015% to 0.030%, by mass %.

14. The steel sheet for a can, according to claim 2, wherein the steel sheet includes Nb in the range from 0.015% to 0.030%, by mass %.

15. A can comprising the steel sheet of claim 1.

16. A can comprising the steel sheet of claim 2.

17. A steel sheet for a can, the steel sheet comprising:

C: 0.0030% or more and 0.0100% or less, by mass %;

Si: 0.05% or less, by mass %;

Mn: 0.10% or more and 1.0% or less, by mass %;

P: 0.030% or less, by mass %;

S: 0.020% or less, by mass %;

Al: 0.010% or more and 0.100% or less, by mass %;

N: 0.0050% or less, by mass %;

Nb: 0.020% or more and 0.050% or less, by mass %; and

Fe and incidental impurities, wherein:

the contents of C and Nb satisfy Formula (1):

$$0.10 \leq ([Nb]/92.9)/([C]/12) \leq 0.37 \quad \text{Formula (1)},$$

[Nb] and [C] represent the contents (mass %) of Nb and C, respectively, the steel sheet has a HR30T hardness of 56 or more, and the steel sheet has an average Young's modulus of 210 GPa or more.

18. The steel sheet for a can, according to claim 17, wherein the steel sheet includes Nb: 0.026% or more and 0.050% or less, by mass %.

19. A steel sheet for a can, the steel sheet comprising:

C: 0.0030% or more and 0.0100% or less, by mass %;

Si: 0.05% or less, by mass %;

Mn: 0.10% or more and 1.0% or less, by mass %;

P: 0.030% or less, by mass %;

S: 0.020% or less, by mass %;

Al: 0.010% or more and 0.100% or less, by mass %;

N: 0.0050% or less, by mass %;

Nb: 0.010% or more and 0.050% or less, by mass %; and

Fe and incidental impurities, wherein:

the contents of C and Nb satisfy Formula (1):

$$0.10 \leq ([Nb]/92.9)/([C]/12) \leq 0.24 \quad \text{Formula (1)},$$

[Nb] and [C] represent the contents (mass %) of Nb and C, respectively, the steel sheet has a HR30T hardness of 56 or more, and the steel sheet has an average Young's modulus of 210 GPa or more.

* * * * *